US010654678B2

(12) United States Patent
Martellono

(10) Patent No.: US 10,654,678 B2
(45) Date of Patent: May 19, 2020

(54) UNIT FOR THERMOSETTING PRINTED FABRICS

(71) Applicant: ATPCOLOR S.r.l., Senago (Milan) (IT)

(72) Inventor: Roberto Maria Martellono, Cerano (IT)

(73) Assignee: ATPCOLOR S.R.L., Milan (IT)

( * ) Notice: Subject to any disclaimer, the term of this patent is extended or adjusted under 35 U.S.C. 154(b) by 0 days.

(21) Appl. No.: 16/163,820

(22) Filed: Oct. 18, 2018

(65) Prior Publication Data

US 2019/0144228 A1 May 16, 2019

(30) Foreign Application Priority Data

Nov. 15, 2017 (IT) ..... 102017000130571

(51) Int. Cl.

| | |
|---|---|
| ***B41J 3/407*** | (2006.01) |
| ***B65H 23/26*** | (2006.01) |
| ***D06P 5/00*** | (2006.01) |
| ***B41M 5/00*** | (2006.01) |
| ***B41J 11/00*** | (2006.01) |
| ***B41J 29/377*** | (2006.01) |
| ***D06B 19/00*** | (2006.01) |
| ***B65H 20/00*** | (2006.01) |
| ***D06B 23/04*** | (2006.01) |

(52) U.S. Cl.

CPC ..... *B65H 23/26* (2013.01); *B41J 3/4078* (2013.01); *B41J 11/002* (2013.01); *B41J 29/377* (2013.01); *B41M 5/0047* (2013.01); *B65H 20/00* (2013.01); *D06B 19/0076* (2013.01); *D06B 23/04* (2013.01); *D06P 5/001* (2013.01); *B65H 2404/14211* (2013.01)

(58) Field of Classification Search

CPC ..... B65H 23/26; B65H 2404/14211; B65H 20/00; B41J 3/4078; B41J 11/002; B41J 29/377; D06P 5/001; B41M 5/0047; D06B 19/0076; D06B 23/04

See application file for complete search history.

(56) References Cited

U.S. PATENT DOCUMENTS

2009/0322824 A1* 12/2009 Hori ..... B41J 2/16585 347/30
2016/0070227 A1* 3/2016 Wada ..... G03G 21/1832 399/128
2019/0143718 A1* 5/2019 Martellono ..... B41J 11/0045

FOREIGN PATENT DOCUMENTS

EP 0464616 A1 1/1992
JP 08002760 A * 1/1996 ..... B65H 23/038

(Continued)

OTHER PUBLICATIONS

Italian Search Report and Written Opinion dated Jul. 5, 2018 for Application No. IT201700130571.

*Primary Examiner* — Yaovi M Ameh
(74) *Attorney, Agent, or Firm* — Patterson + Sheridan, LLP

(57) ABSTRACT

A unit for thermosetting printed fabrics, comprising: a heated roller rotating about a rotation axis and having a cylindrical outer surface, at least one fabric guiding element having an inner wall facing the cylindrical outer surface of the heated roller and defining a gap with the cylindrical outer surface of the heated roller, for passing the fabric wherein said fabric guiding element is carried by an adjusting device rotatable about said rotation axis to adjust the angular position of said guiding element about said rotation axis.

6 Claims, 12 Drawing Sheets

(56) References Cited

FOREIGN PATENT DOCUMENTS

| | | | |
|---|---|---|---|
| JP | H082760 | A | 1/1996 |
| JP | 3810852 | B2 | 8/2006 |

* cited by examiner

UNIT FOR THERMOSETTING PRINTED FABRICS

CROSS-REFERENCE TO RELATED APPLICATIONS

This application claims benefit of Italian patent application number 102017000130571, filed Nov. 15, 2017 which is herein incorporated by reference.

BACKGROUND OF THE INVENTION

Field of the Invention

The present invention relates in general to textile printers for digital printing on fabrics.

More particularly, the invention relates to a unit for thermosetting the colors (inks) onto the fabrics.

Description of Prior Art

In digital printing on fabrics, thermosetting of the inks on the fabric may be necessary. In these cases, it is common to use a thermosetting unit comprising a heated roller, rotatable about a rotation axis and having a cylindrical outer surface on which the moving fabric is wound with a predetermined winding angle. The thermosetting unit can be integrated into the textile printer (in-line thermosetting) or it can be a stand-alone unit separate from the textile printer. The working temperature on the outer surface of the heated roller in contact with the fabric can be between 100-200° C. Heating of the heated roller can be obtained by means of diathermic oil circulating inside the heated roller in contact with the outer surface, or by means of an infrared lamp located inside the heated roller.

The fabric for thermosetting almost completely wraps the outer surface of the heated roller and moves at a speed equal to the peripheral speed of the heated roller.

In solutions according to the prior art, the contact angle between the fabric and the heated roller is fixed. To improve the quality of the thermosetting process, especially in the case of in-line thermosetting (printing on textile support and immediate thermosetting), it would be desirable to provide a system that allows varying of the winding angle of the fabric on the heated roller, for example as a function of printing speed, print resolution, type of material used, operating temperature, inks used, etc.

The document JP 3 810852 B2 describes a unit comprising a heated roller rotating about a rotation axis, and a fabric guiding device comprising two rollers which guide the fabric in contact with the outer surface of the heated roller, wherein the rollers of the guiding device are movable to adjust the winding angle of the fabric around the heated roller.

SUMMARY OF THE INVENTION

The present invention aims to provide a unit for thermosetting printed fabrics which enables the aforementioned requirement to be satisfied.

According to the present invention, this object is achieved by a thermosetting unit having the characteristics described herein.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

It will be appreciated that, for clarity and simplicity of illustration, the various figures may not be reproduced on the same scale.

DETAILED DESCRIPTION

Figure 1:
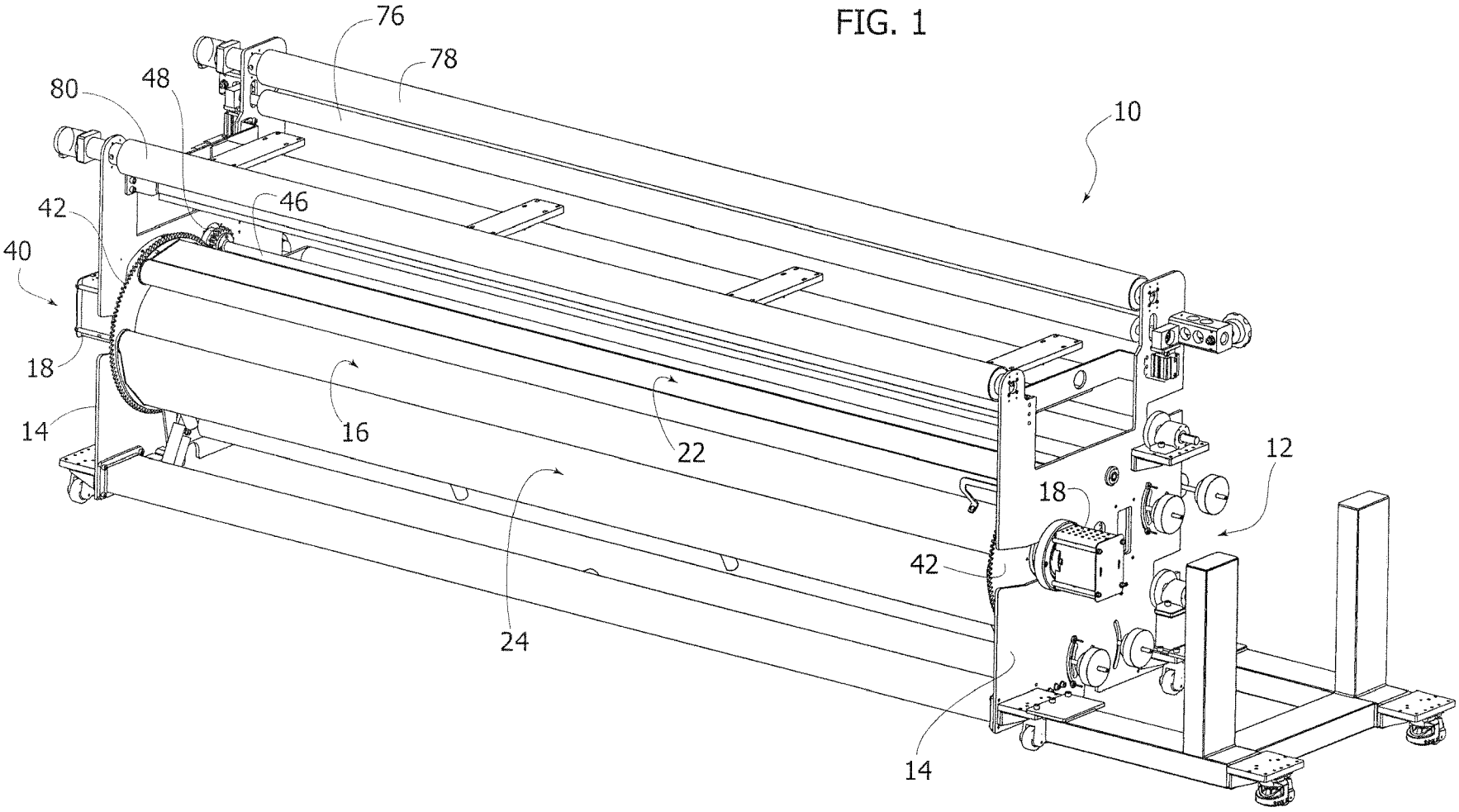
FIG. 1 is a perspective view of a thermosetting unit according to the present invention.
Figure 2:
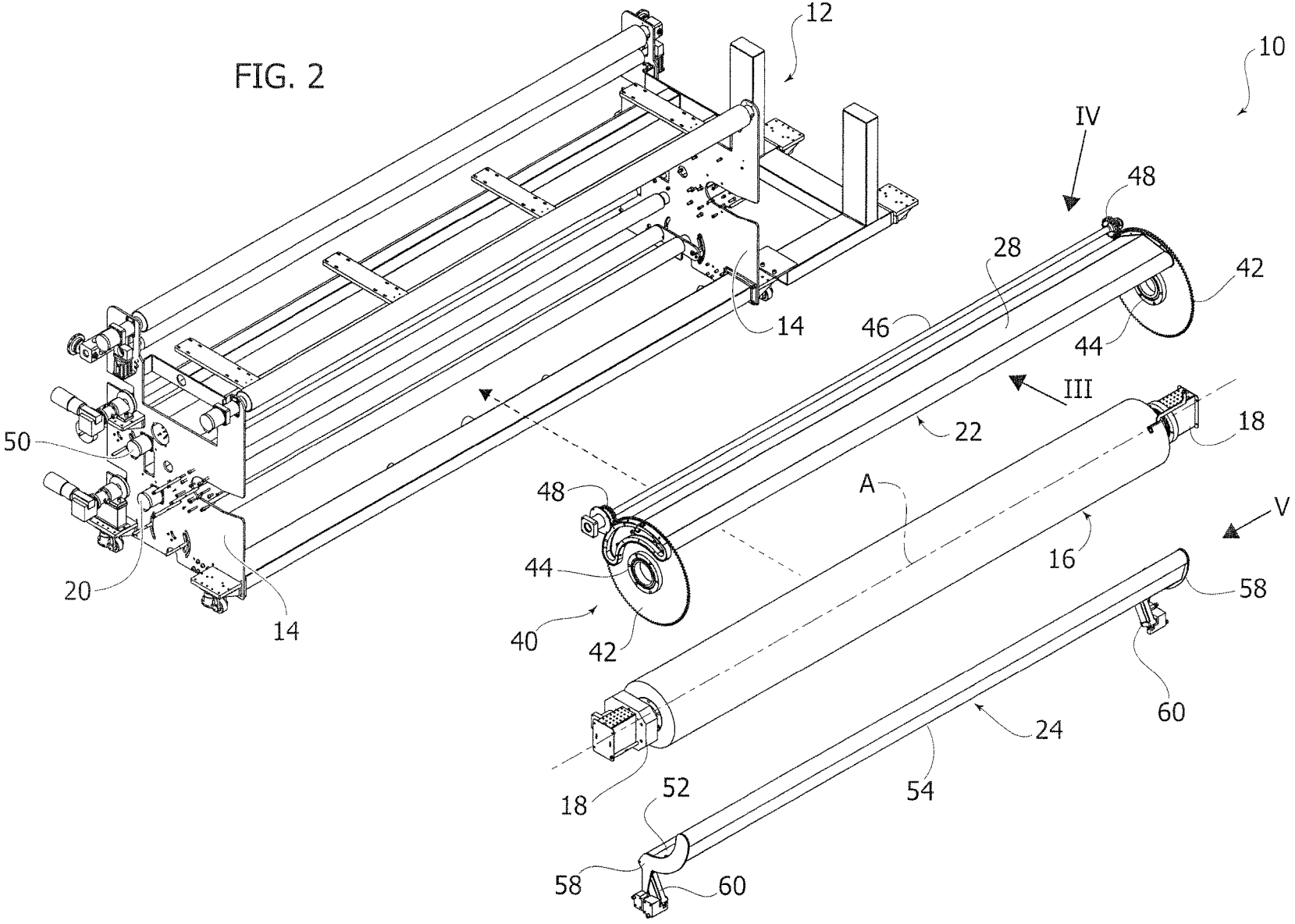
FIG. 2 is an exploded perspective view of the thermosetting unit of FIG. 1.

With reference to FIGS. 1 and 2, numeral 10 indicates a unit for thermosetting printed fabrics. The thermosetting unit 10 can either be a stand-alone unit or it can be integrated into a textile printer for thermosetting the inks onto the fabric immediately after printing.

The thermosetting unit 10 comprises a stationary supporting structure 12 including two sides 14 formed by two vertical walls parallel to each other.

The thermosetting unit 10 comprises a heated roller 16 having a cylindrical outer surface and carried in a rotatable manner about a rotation axis A by two side supports 18 fixed to the sides 14 of the stationary supporting structure 12. The heated roller 16 is rotated about the axis A by means of an electric motor 20 which can be carried by one of the sides 14 of the stationary supporting structure 12 (FIG. 2).

With reference in particular to FIG. 2, the thermosetting unit 10 comprises a first guiding element 22 and a second guiding element 24, facing the cylindrical outer surface of the heated roller 16 and configured to guide the fabric in contact with the cylindrical outer surface of the heated roller 16.

Figure 3:
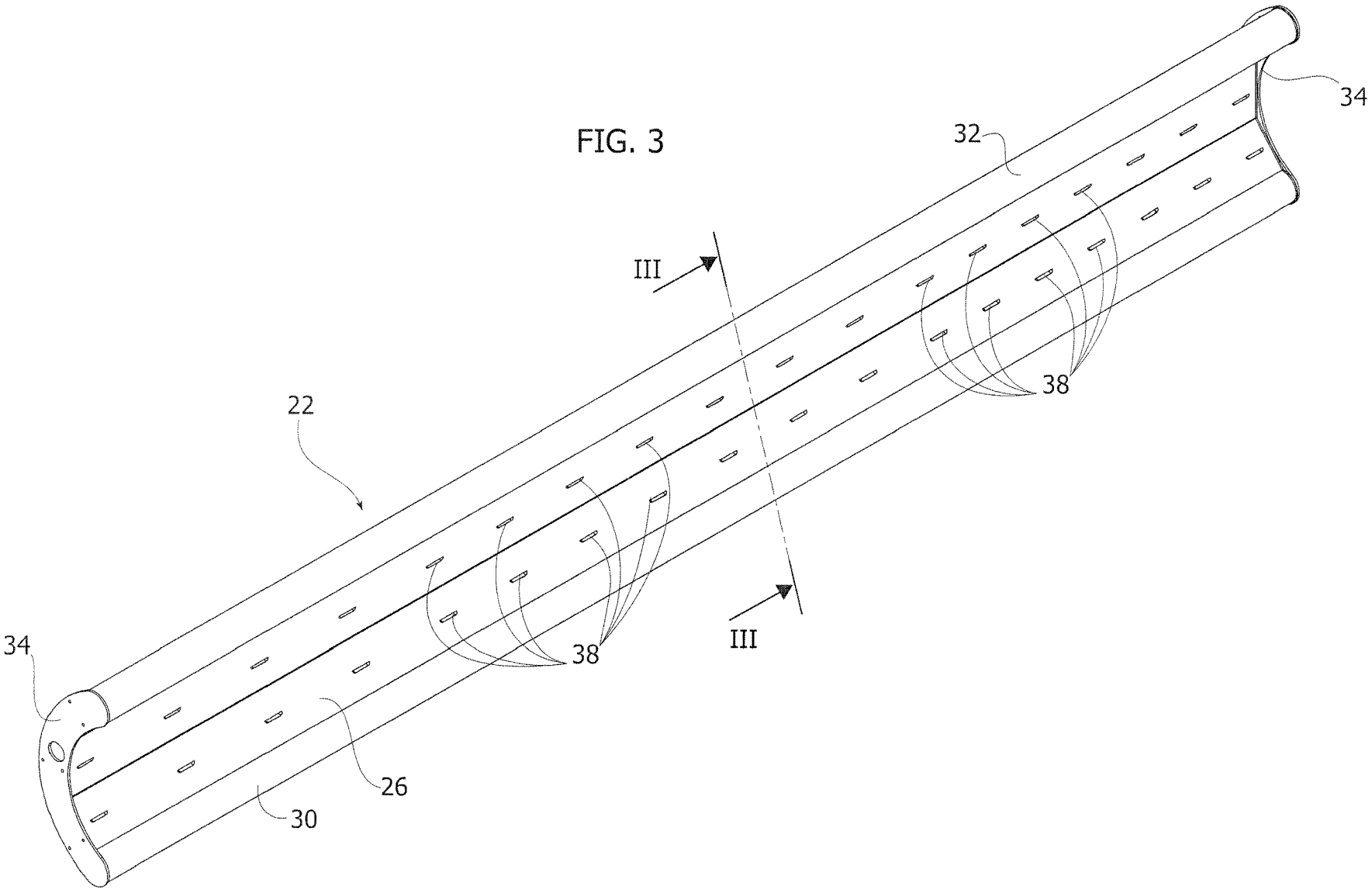
FIG. 3 is a perspective view of the fabric guiding element indicated by the arrow III in FIG. 2.
Figure 3A:
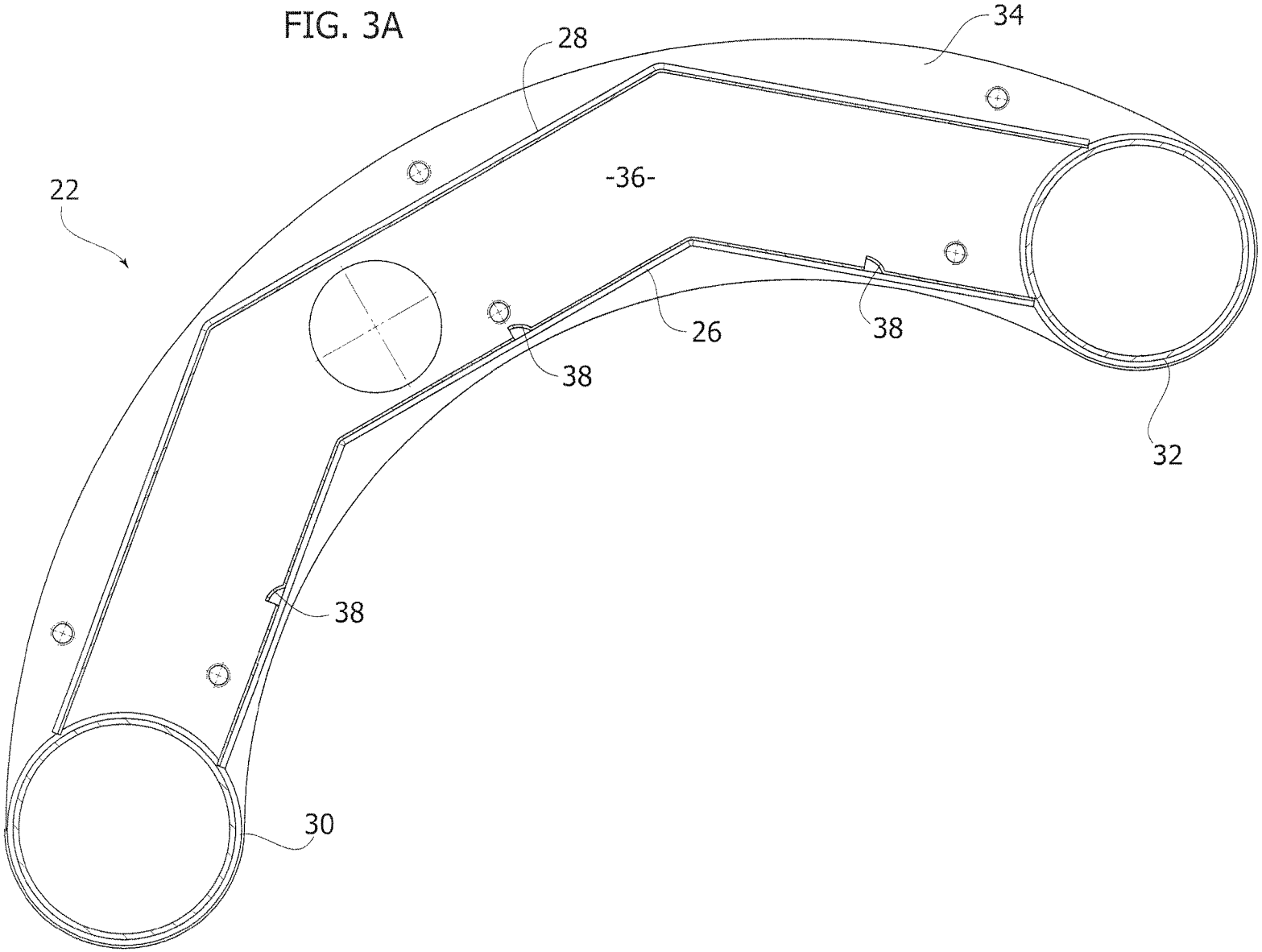
FIG. 3A is a cross-section along the line III-III of FIG. 3.

With reference to FIGS. 3 and 3A, the first guiding element 22 has a wing profile shape, with a concave inner surface facing the heated roller 16 and a convex outer surface. The first guiding element 22 may comprise an inner wall 26 and an outer wall 28 made of sheet metal. The first guiding element 22 may comprise two tubular elements 30, 32 parallel to each other and fixed to the walls 26, 28. The first guiding element 22 may comprise two end plates 34 fixed to opposite ends of the walls 26, 28. As illustrated in FIG. 3A, the inner wall 26 and the outer wall 28 of the first guiding element 22 are spaced apart and define a hollow volume forming a fume suction chamber 36, connected to a suction source (not illustrated). The inner wall 26 can be provided with a plurality of holes 38 for extracting fumes.

Figure 4:
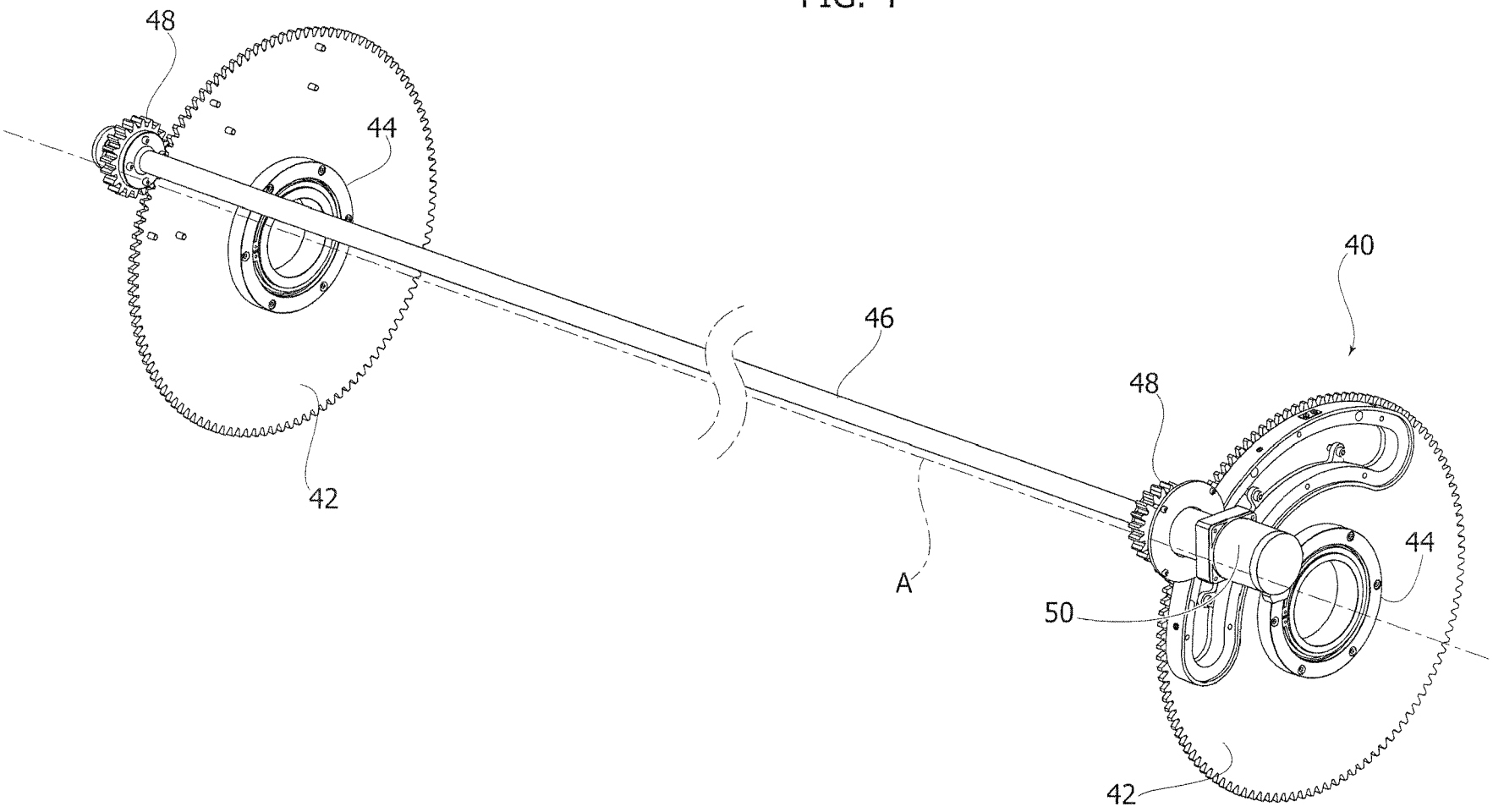
FIG. 4 is a perspective view of an adjusting device indicated by the arrow IV in FIG. 2.

With reference to FIGS. 2 and 4, the first guiding element 22 is carried by an adjusting device 40 rotatable about the axis A to adjust the angular position of the first guiding element 22 with respect to the heated roller 16. The adjusting device 40 comprises two gears 42 provided with respective bearings 44 which rotatably engage the supports 18 of the heated roller 16. The gears 42 can rotate about the axis A independently of the heated roller 16. The first guiding element 22 is fixed at its opposite ends to the gears 42, as illustrated in FIG. 2. The gears 42 are spaced apart from each other by a distance slightly greater than the length of the heated roller 16, which is mounted between the gears 42.

The adjusting device 40 comprises a shaft 46 parallel to the rotation axis A, rotatably carried by the sides 14 of the stationary supporting structure 12. The shaft 46 is rotatable about its own axis and is in a fixed position with respect to the stationary supporting structure 12. Two toothed sprockets 48 are fixed on the shaft 46, which engage with the respective gears 42. The shaft 46 is rotated about its axis by a motor 50 carried by one of the sides 14 of the stationary supporting structure 12. The motor 50 controls the joint rotation of the two gears 42 about the axis A. Thus, the motor 50 can adjust the angular position of the first guiding device 22 about the heated roller 16.

Figure 5:
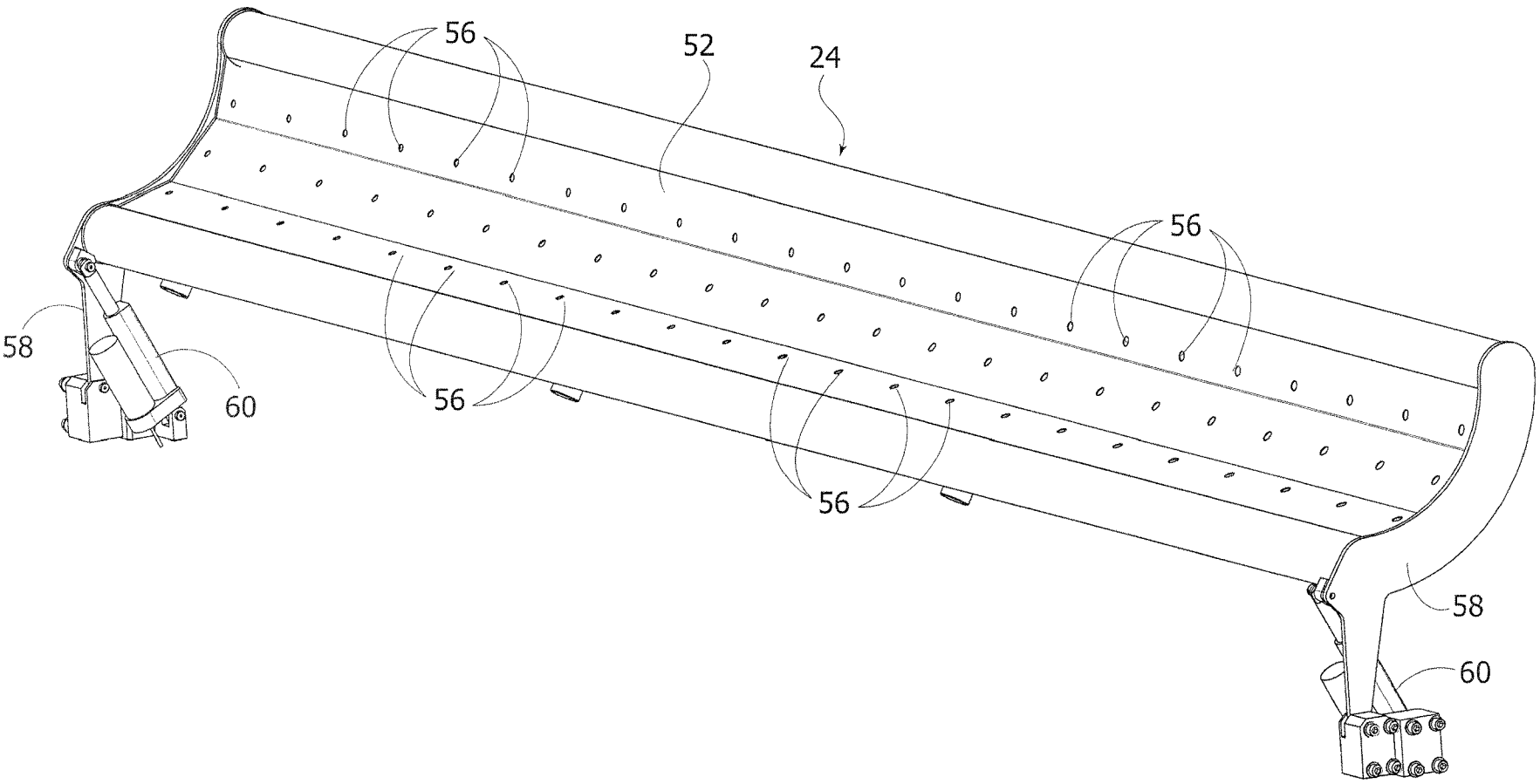
FIG. 5 is a perspective view of a second fabric guiding element indicated by the arrow V in FIG. 2.

With reference to FIGS. 2 and 5, the second guiding element 24 may have a structure similar to that of the first guiding element 22. The second guiding element 24 may also have a wing profile shape with a concave inner wall 52 facing the heated roller 16 and a convex outer wall 54. The second guiding element 24 may also have a fume suction chamber defined between the inner wall 52 and the outer wall 54 and connected to a suction source. The inner wall 52 can be provided with a plurality of holes 56 for extracting fumes. The second guiding element 24 can be fixed to two levers 58 located at opposite ends of the guiding element 24 and articulated about a common axis parallel to the rotation axis A. The levers 58 are associated with respective linear actuators 60 which can be actuated for controlling an oscillation movement of the second guiding element 24 between an operative position and an inoperative position.

Figure 11:
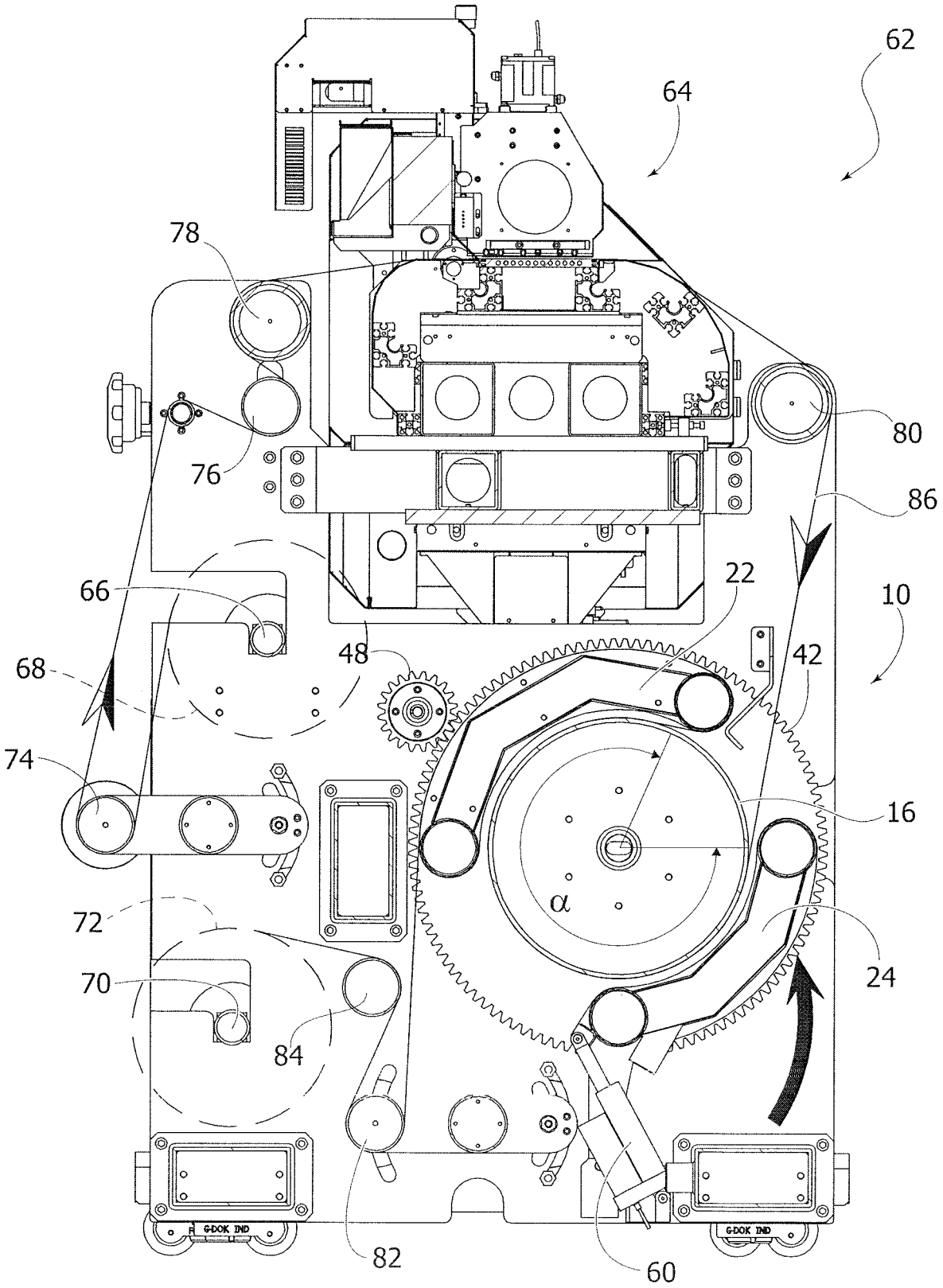

FIGS. 6 to 11 show a textile printer 62 comprising a thermosetting unit 10 according to the present invention. The textile printer 62 comprises a printing unit 64 for digital printing on a moving fabric. The textile printer 62 comprises a first reel 66 on which a bobbin 68 of fabric to be printed is rotatably mounted, and a second reel 70 on which the printed fabric wraps, forming a bobbin 72 (FIG. 11). The textile printer 62 comprises a plurality of rollers 74, 76, 78, 80, 82, 84 which feed and guide the fabric in its movement through the printing head 64 and through the thermosetting unit 10. FIGS. 6-11 illustrate different steps of the insertion procedure of the fabric through the thermosetting unit 10.

Figure 6:
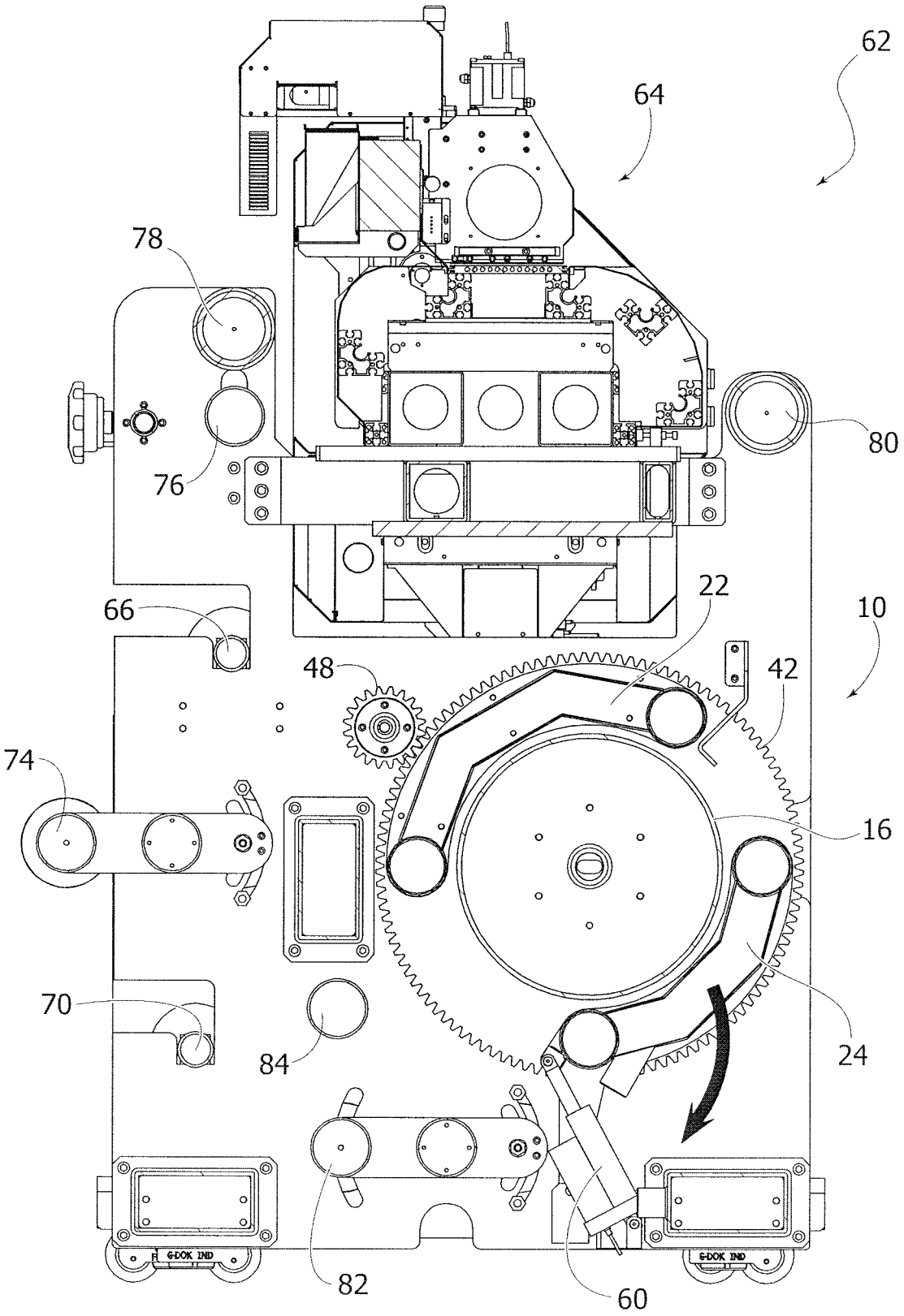
FIGS. 6 to 11 are schematic side views of a textile printer comprising a thermosetting unit according to the present invention, illustrating different steps of the fabric insertion operation.
Figure 7:
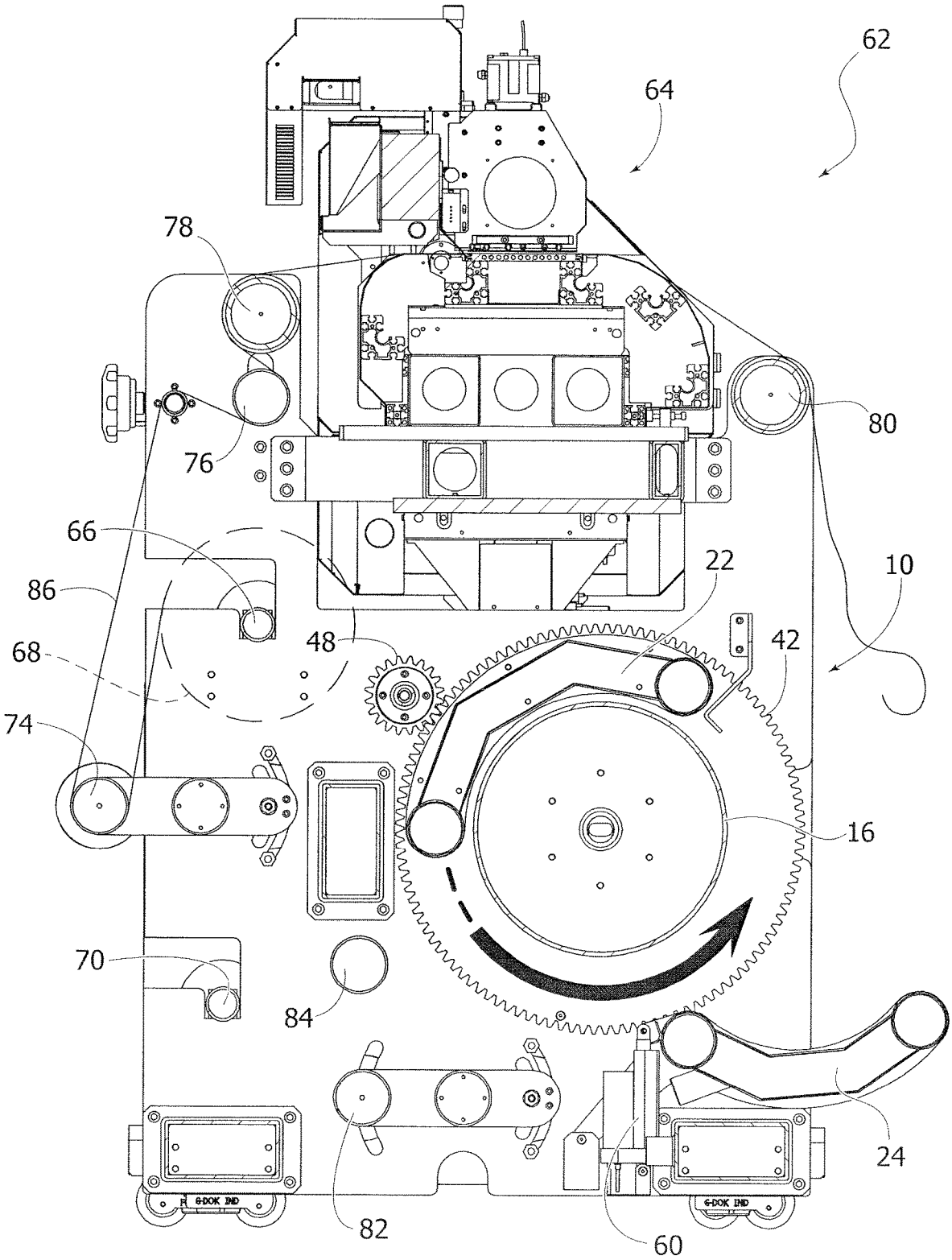
Figure 8:
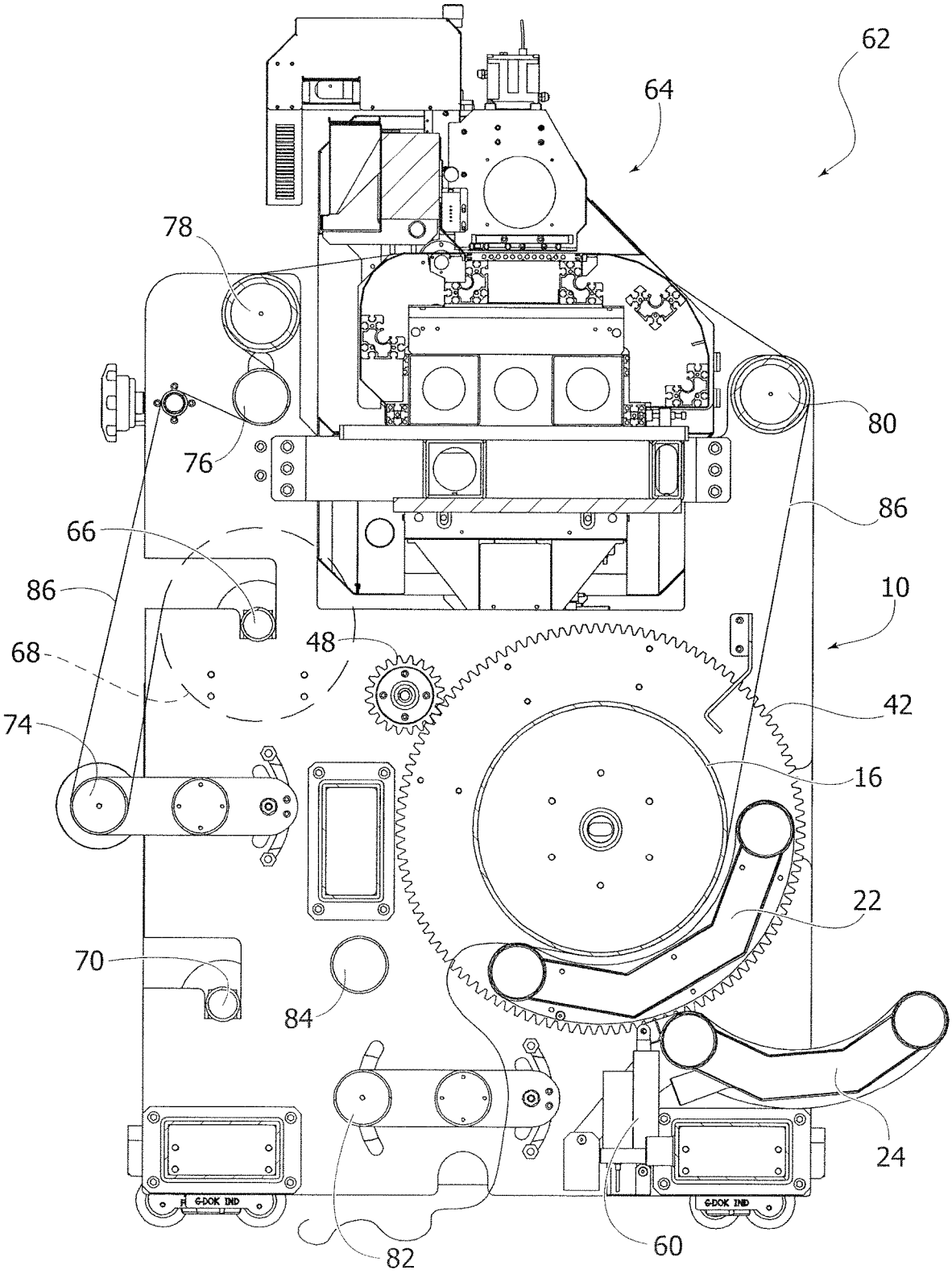
Figure 9:
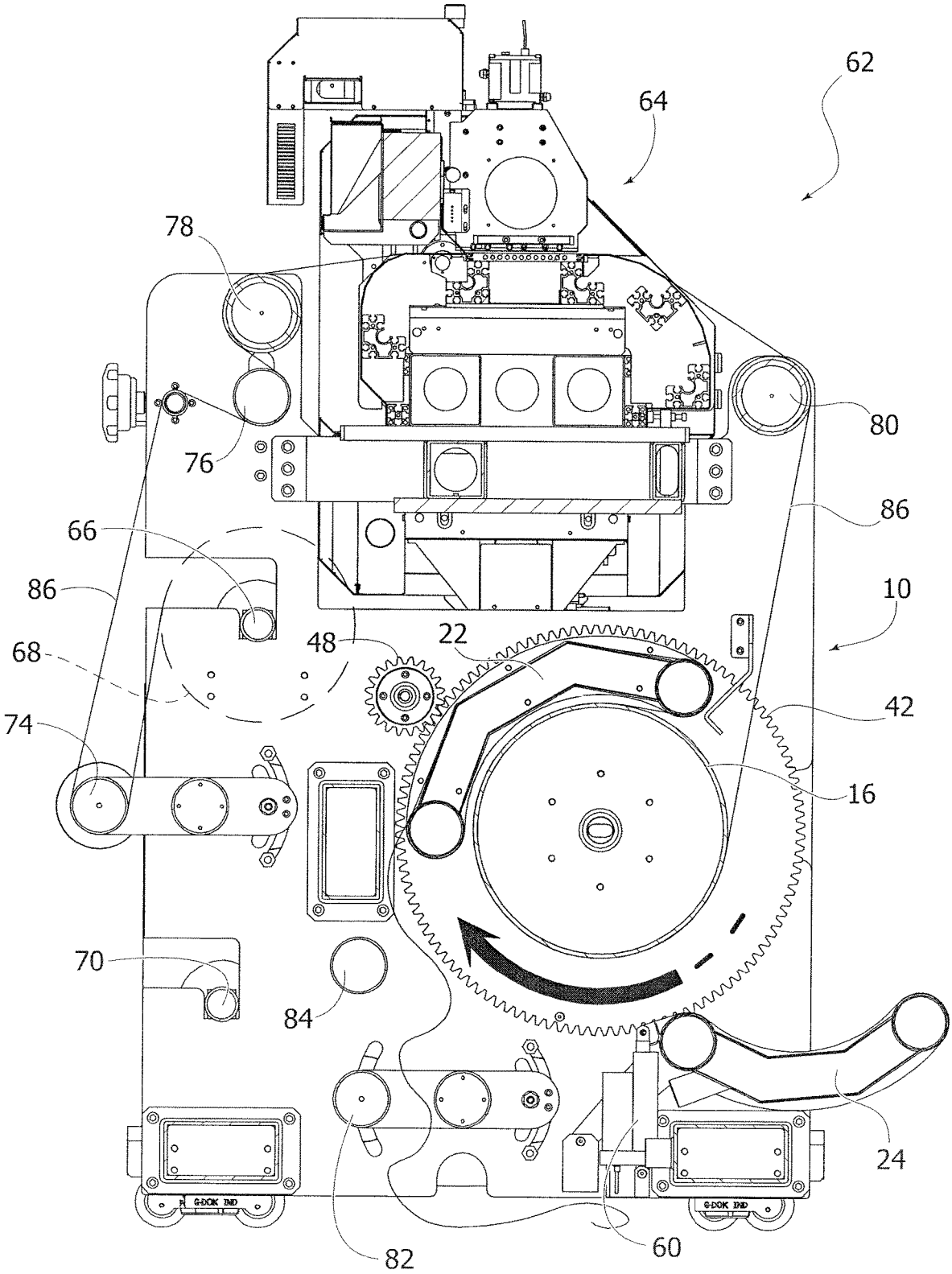
Figure 10:
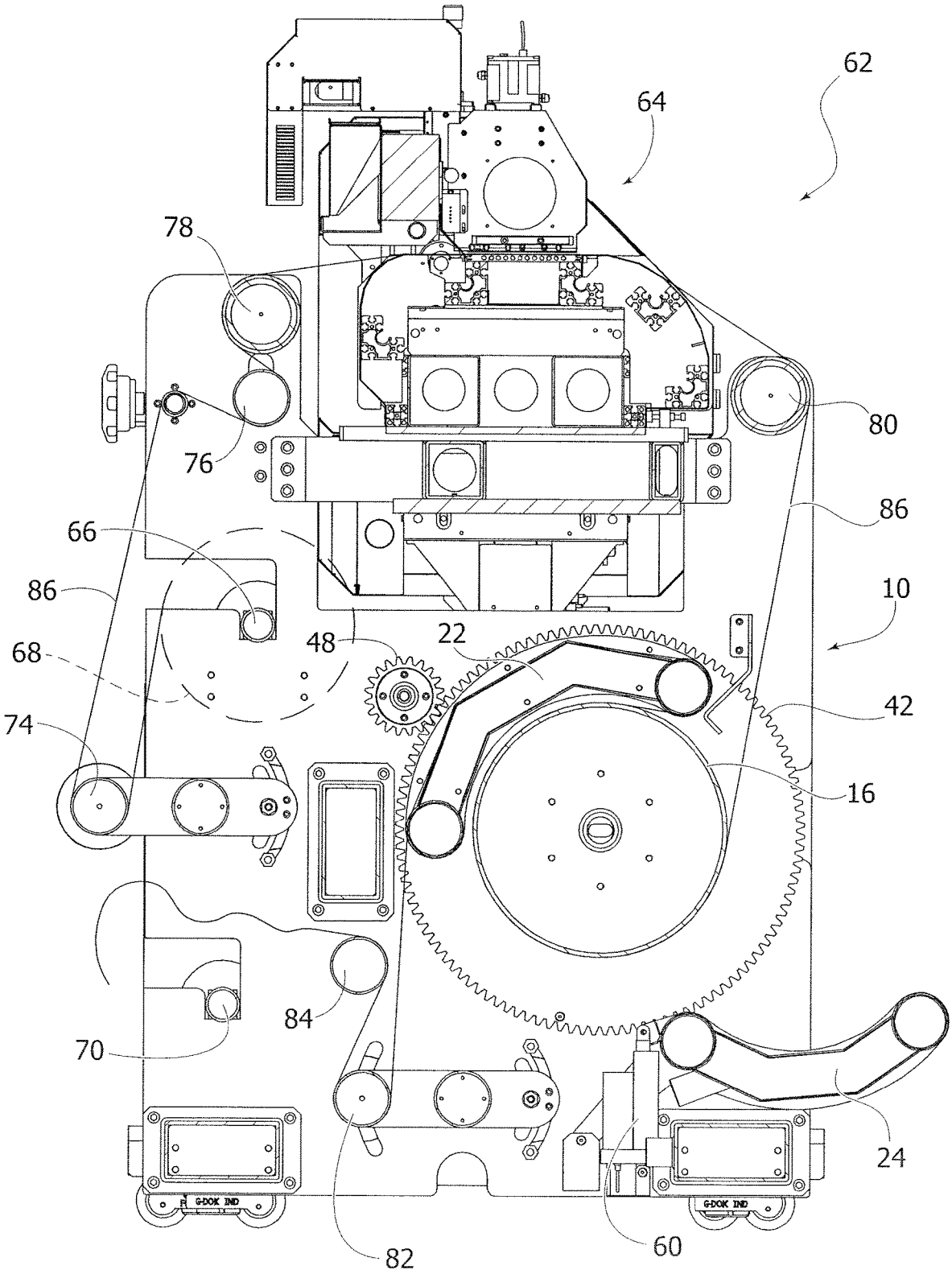

FIG. 6 illustrates the textile printer 62 in a configuration in which the fabric to be printed has not yet been loaded onto the machine. Starting from this initial configuration, a bobbin 68 of fabric to be printed is positioned on the first reel 66. The fabric 86 is unwound from the bobbin and is passed onto the rollers 74, 76, 78 and through the printing unit 64. The second guiding element 24 is carried into the inoperative position as illustrated in FIG. 7, in which the inner wall of the second guiding element 24 is far from the outer surface of the heated roller 16. With the second guiding element 24 in the inoperative position, a space is released around the outer surface of the heated roller 16. In this condition, the toothed sprockets 48 are rotated, which cause the gears 42 to rotate in an anti-clockwise direction. In this way, the first guiding element 22 rotates anti-clockwise and moves to the position illustrated in FIG. 8. With the first guiding element in this position, the leading end of the fabric 86 is passed between the outer surface of the heated roller 16 and the inner surface of the first guiding element 22 (FIG. 8). Subsequently, the toothed sprockets 48 are rotated in the opposite direction to rotate the gears 42 clockwise, so as to bring the first guiding element 22 back to its initial position, as illustrated in FIG. 9. The fabric 86 is wound onto the outer surface of the heated roller 16 and passes into a gap defined between the outer surface of the heated roller 16 and the inner surface of the first guiding element 22. The fabric 86 is folded onto the outer surface of the first guiding element 22 and is passed around the rollers 82 and 84. Finally, as illustrated in FIG. 11, the fabric 86 is wound onto a bobbin positioned on the second reel 70. At this point, the second guiding element 24 is brought into the operative position in which the inner surface of the second guiding element 24 forms a gap with respect to the outer surface of the heated roller 16, through which the fabric 86 passes.

FIG. 11 illustrates the textile printer 62 in the normal operating condition. In this condition, the fabric 86 runs from the first bobbin 68 and advances in the direction indicated by the arrows passing through the printing unit 64. At the output of the printing unit 64, the fabric 86 is wound onto the outer surface of the heated roller 16 and passes through the two gaps formed between the outer surface of the heated roller 16 and the inner surfaces of the guiding elements 22, 24. The guiding elements 22, 24 hold the fabric 86 in contact with the outer surface of the heated roller 16, with a winding angle denoted by a in FIG. 11.

The thermosetting unit according to the present invention allows variation of the contact angle $\alpha$ of the fabric 86 with the heated outer surface of the heated roller 16. Adjusting the contact angle allows the contact time between the fabric and the heated roller to be varied. Therefore, a different contact time can be set according to the type of fabric (elastic, light, or heavy, of different weft and warp, fabric or non-woven fabric or of different weights).

Adjusting the contact angle $\alpha$ is obtained by adjusting the angular position of the first guiding element 22 about the axis A by means of the adjusting device 40. The contact angle $\alpha$ can be adjusted according to operating parameters such as: print speed, print resolution, type of fabric, operating temperature, inks used, etc.

The possibility of adjusting the contact time between the fabric and the outer surface of the heated roller 16 allows improvement of the quality of the thermosetting process, especially in the case where the thermosetting is carried out immediately after the printing step as in the case of a thermosetting unit arranged in-line with the textile printer.

When the printing or movement of the fabric stops (for example, for a cleaning operation, due to an error, while waiting for a subsequent print, or due to an emergency), it is possible to detach the fabric from contact with the heated roller to prevent any thermosetting defects. When the problem that caused the printer to stop is resolved, the adjusting device automatically returns the fabric so that it is in contact with the heated roller at the set winding angle.

The solution according to the present invention also allows suction of the fumes formed during the thermosetting process. Suction of the fumes takes place inside the guiding elements 22, 24 and does not require other elements for extracting the fumes.

Furthermore, the solution according to the invention allows simplification and speeding up of the insertion operations of the fabric.

Of course, without prejudice to the principle of the invention, the details of construction and the embodiments may be widely varied with respect to those described and illustrated, without thereby departing from the scope of the invention as defined by the claims that follow.

The invention claimed is:

1. A unit for thermosetting printed fabrics, comprising:

a heated roller rotating about a rotation axis and having a cylindrical outer surface;

a first guiding element carried by an adjusting device for adjusting the angular position of said first guiding element about said rotation axis, wherein said first guiding element is rotatable about said rotation axis and wherein said first guiding element has substantially the shape of a wing profile having an inner wall facing the cylindrical outer surface of the heated roller and defining a gap with the cylindrical outer surface of the heated roller, for passing the fabric; and a second guiding element movable between an operative position and an inoperative position, wherein said second guiding element is fixed to a pair of levers articulated about an axis parallel to said rotation axis, said levers being associated with respective linear actuators which control oscillation of said second guiding element between said operative position and said inoperative position.

2. A unit according to claim 1, wherein said adjusting device comprises two gears to which opposite ends of said first guiding element are fixed, said gears being rotatable about said rotation axis independently of said heated roller.

3. A unit according to claim 2, wherein said adjusting device comprises a shaft carrying two toothed sprockets which engage with respective gears, said shaft being rotated by a motor.

4. A unit according to claim 1, wherein said first guiding element has a fume suction chamber connected to a suction source, and that the inner wall of said guiding element is provided with a plurality of suction holes.

5. A unit according to claim 1, wherein the second guiding element has an inner wall facing the cylindrical outer surface of the heated roller provided with a plurality of holes for extracting fumes.

6. A textile printer comprising:

a printing unit for printing on a moving fabric; and a thermosetting unit including:

a heated roller rotating about a rotation axis and having a cylindrical outer surface, a first guiding element carried by an adjusting device for adjusting the angular position of said first guiding element about said rotation axis, wherein said first guiding element is rotatable about said rotation axis and wherein said first guiding element has substantially the shape of a wing profile having an inner wall facing the cylindrical outer surface of the heated roller and defining a gap with the cylindrical outer surface of the heated roller, for passing the fabric, and a second guiding element movable between an operative position and an inoperative position, wherein said second guiding element is fixed to a pair of levers articulated about an axis parallel to said rotation axis, said levers being associated with respective linear actuators which control oscillation of said second guiding element between said operative position and said inoperative position, wherein fabric conveyed from an output of the printing unit is wound onto the cylindrical outer surface of the headed roller.

* * * * *